United States Patent [19]

Bolza-Schünemann et al.

[11] Patent Number: 4,896,808

[45] Date of Patent: Jan. 30, 1990

[54] DEVICE FOR THE CONTROLLED INFEED OF A WEB TO A PRINTING MACHINE, METHOD FOR REGULATING A CORRESPONDING CONTROL SIGNAL, AND DEVICE FOR PERFORMING THE METHOD

[75] Inventors: Claus August Bolza-Schünemann; Johannes G. Schaede, both of Würzburg, Fed. Rep. of Germany

[73] Assignee: Koening & Bauer Aktiengesellschaft, Wurzburg, Fed. Rep. of Germany

[21] Appl. No.: 242,897

[22] Filed: Sep. 12, 1988

[30] Foreign Application Priority Data

Sep. 17, 1987 [DE] Fed. Rep. of Germany ..... 3731214

[51] Int. Cl.[4] ..... B65H 23/185

[52] U.S. Cl. ..... 226/42; 226/44; 242/75.51

[58] Field of Search ..... 226/15, 42, 44, 45, 226/196, 197; 242/75.51

[56] References Cited

U.S. PATENT DOCUMENTS

| | | | |
|---|---|---|---|
| 2,906,143 | 9/1959 | Musser . | |
| 2,946,087 | 7/1960 | Haroldson et al. | 226/42 X |
| 3,539,085 | 11/1970 | Anderson et al. . | |
| 3,724,733 | 4/1973 | Schaffer et al. . | |
| 3,811,304 | 5/1974 | Gorker | 226/42 |
| 3,905,533 | 9/1975 | Corse | 226/44 |
| 3,912,145 | 10/1975 | Mezhoter | 226/44 |
| 4,011,976 | 3/1977 | Greer | 226/42 X |
| 4,407,331 | 10/1983 | Rehling et al. | 242/75.51 X |

FOREIGN PATENT DOCUMENTS 2305249 10/1984 Fed. Rep. of Germany .

*Primary Examiner*—Joseph J. Hail, III

*Attorney, Agent, or Firm*—Jones, Tullar & Cooper

[57] ABSTRACT

In a device and a method for the regulation of the controlled infeed of web material to a printing machine, a control component of a differential gear placed ahead of a web drive roller is driven by a second continuously adjustable drive by the main drive of the printing machine. Control of the second drive takes place via a servomotor which is connected by a control circuit with a tensioning roller deflectable by the paper web. During control the voltage signal generated by the deflection of the tensioning roller is converted parallel into a voltage signal characterizing the position of the tensioning roller and into a voltage signal weighting the direction of movement. Then these signals are linked into a single output signal and are routed to the servomotor.

7 Claims, 3 Drawing Sheets

DEVICE FOR THE CONTROLLED INFEED OF A WEB TO A PRINTING MACHINE, METHOD FOR REGULATING A CORRESPONDING CONTROL SIGNAL, AND DEVICE FOR PERFORMING THE METHOD

FIELD OF THE INVENTION

The present invention relates, in general, to a device for controlling the infeed of web material to a printing machine, and more particularly, to a compensating system for regulating the web tension. The web is supplied to the printing machine by motor-driven rollers, with a tensioning roller in the form of a compensating, or dancer roller, disposed between a traction roller which draws the web from a supply and feed rollers which feed the web to the printing machine. A control system based on signals representing the nominal value of the web tension and the measured actual value of the web tension regulates a compensating drive for the traction roller through the use of a differential drive gear for the traction roller. The differential drive has at least a drive component, a power take off component and a control component. The invention further relates to a method for controlling a deflectable tensioning roller so as to return it to a predetermined position in accordance with the value of an error signal generated by deflection of the tensioning roller away from its nominal value, as well as to apparatus for performing the method.

BACKGROUND OF THE INVENTION

German Patent 23 05 249 and corresponding U.S. Pat. No. 3,724,733 disclosed a web infeed device in which the tension of a roll or web of paper is kept constant by means of a tensioning roller in the form of a compensating roller. In order to return the compensating roller into a preset initial position after a deflection caused by a breakdown; i.e., a change in the tension of the paper web, a traction roller with a shaft drive is located upstream of the compensating roller. The shaft drive of the traction roller is driven both by the main drive of the printing machine and by a second drive which is a reversible servomotor so that the rpm of the main drive and of the servomotor are cumulatively superimposed on each other by means of the shaft drive. The servomotor is controlled by a control circuit which receives a tension signal, or error signal, which is proportional to the deflection of the tensioning roller from its nominal position. A strain gauge element provides the tension signal and this signal is cumulatively combined with a signal proportional to the speed of the traction roller to provide proportional reinforcement of this signal, the proportional speed-dependent portion of the control circuit being located in the measuring element.

A disadvantage of the device shown in German Patent 23 05 249 is the use of a servomotor which is powered separately from the main drive of the printing machine, which motor must be precisely controlled in its rpm, and which is connected to the cumulative drive. For one thing, this motor and its rpm governor must be so powerful, because of their function, as to entail considerable cost for their acquisition and operation. For another, a motor of the size required for this purpose has the disadvantage that its rotating parts have a large mass which is difficult to reverse because of its physical inertia.

A further disadvantage of devices such as that shown in the German Patent 23 05 249 is the use of a control circuit which, although supplied with a signal proportional to the speed of the traction roller, does not provide a signal which corresponds to the rate of deflection of the tensioning roller which is to be controlled. However, the decisive disadvantage of this device lies in the fact that if the motor, its rpm governor, or the controller becomes inoperative, the traction roller can only be operated at an rpm which is proportional to the speed of the printing machine. As a result, the feed device operates with only one defined roll tension which, depending on the type of paper used, may exceed the required input tension of the printing machine (with thin paper) or may fail to attain the required tension (with heavy paper).

SUMMARY OF THE INVENTION

It is an object of the present invention to provide a method and apparatus for returning a deflectable tensioning roller to a predetermined initial position, and further to a method for producing a control signal which is proportional to the position, rate of motion, and direction of motion of the tensioning roller, as well as apparatus for performing this method.

Briefly, the present invention is directed to an apparatus for and a method for controlling the tension of a web being fed to a printing machine. The web is drawn from a source such as a paper reel, which may be a reel in a reel changer or web splicer, by a traction roller, is fed around a tension, or dancer roller, to a pair of feed rollers which deliver the web to a printing machine. The tension roller moves about a pivot point in response to changes in the tension of the web, and this motion produces a corresponding output signal. The output signal is fed through three parallel control networks to obtain signals representing the direction, amount, and rate of change of the motion of the tension roller about the pivot point.

The signals in the three control networks are weighted, and the resulting outputs are combined in logic circuits to produce a control drive signal which is connected to a servomotor-driven controller for the traction roller drive mechanism. The control signal operates the servomotor to regulate the speed of the traction motor so as thereby to return the web to the proper tension and thereby to return the tension roller to its initial position.

The servomotor regulates a continuously variable disc drive arrangement which, in turn, operates a compound gear arrangement such as a differential gear, a planetary gear, a harmonic drive, or the like, which is interposed between the main drive shaft for the printing machine and the traction roller so that the traction roller drive is varied in accordance with the output tension signal produced by the tension roller. The adjustable disc drive is also manually adjustable so that the system can be adjusted to the various paper web tensions required for different paper types even if the servomotor or the control network breaks down.

The drive power for the tractor roller and its controlling disc drive is obtained from the main drive of the printing machine so that expensive additional drive motors are not required. This not only reduces production costs, but also lowers the susceptibility of the device to breakdown. The control arrangement of the present invention also results in a sturdy, reliable, and stable system to produce statically and dynamically constant web tension. The particular advantage of the present invention lies in the fact that if the control apparatus or the servomotor break down the device can be operated with a manually selectable constant tension and although compensation for dynamic disturbances by the compensating roller would be lacking, a web tension for various types of paper can be manually selected over a long period of time so that emergency production becomes possible.

BRIEF DESCRIPTION OF THE DRAWINGS

The foregoing and additional objects, features and advantages of the present invention will become apparent to those of skill in the art from a consideration of the following detailed description of a preferred embodiment thereof, taken in conjunction with the accompanying drawings, in which.

DETAILED DESCRIPTION OF A PREFERRED EMBODIMENT

Figure 1:
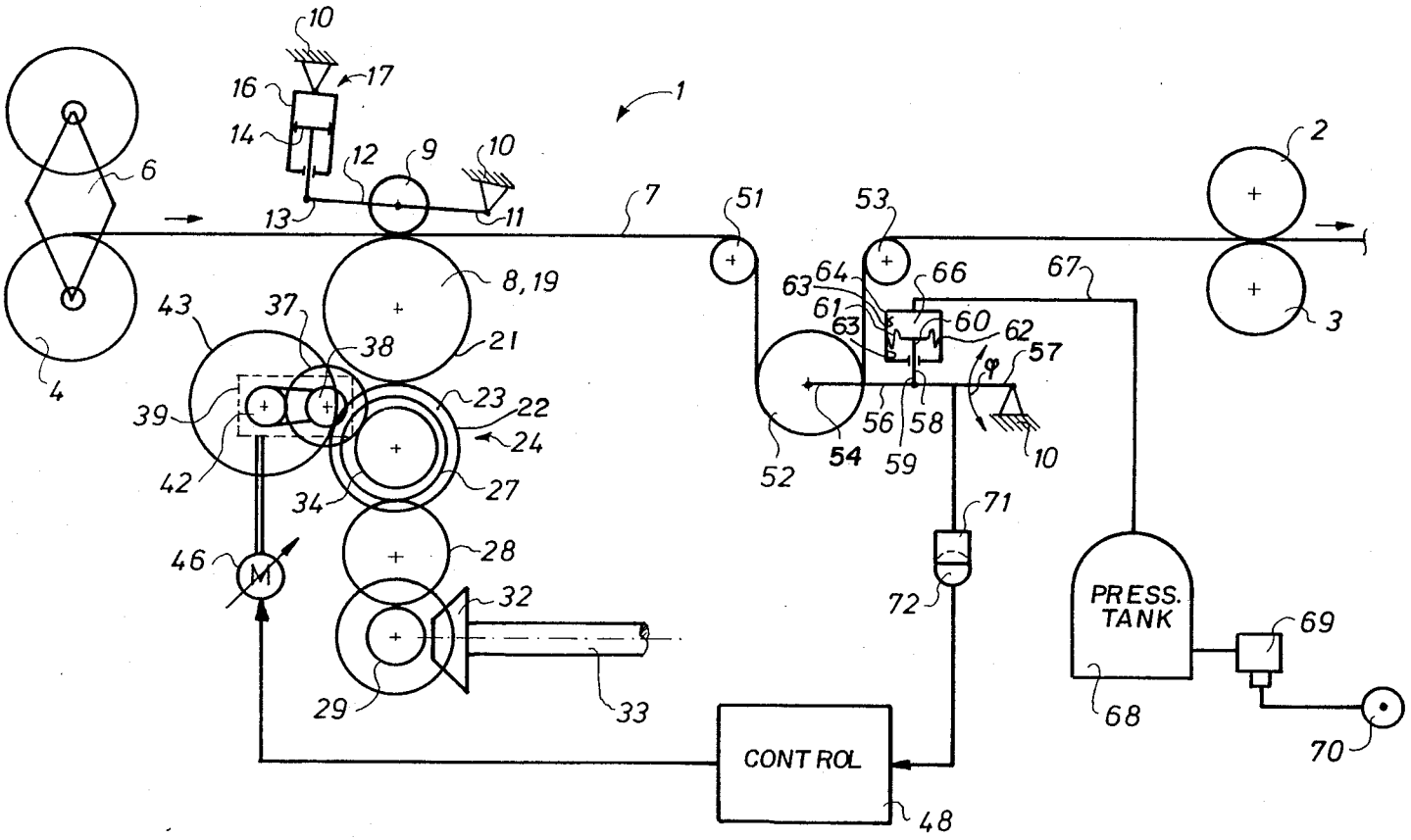
FIG. 1 is a schematic view of a web feed device equipped with the tension control apparatus of the present invention.

Turning now to a more detailed description of the drawings, there is illustrated in FIG. 1 a web feed device 1 for a printing machine (not shown). The feed device includes a pair of cooperating feed rollers 2 and 3 which supply the web material to a printing machine from a paper reel 4 which is a part of a reel changer or web splicer 6. The web material 7 is drawn from the reel 4 over a traction roller 8, or drag roller, cooperating with a pressure roller 9. The pressure roller is mounted in side frames 10 of the feed device with a first end 11 of a lever 12 being pivotally supported to the side frame. The pressure roller is rotatably mounted at the center of a pair of levers 12, one lever being located at each end of the roller, with the pivotal supports at the first ends 11 of the two levers being laterally symmetrical in the side frame. A second end 13 of each of the levers 12 is flexibly connected with a piston 14 mounted in a cylinder 16 of a pressure device 17. The pressure devices 17 are fixed on the side frames 10 of the feed device 1 and provide the pressure required to hold pressure roller 9 against the surface of the traction roller 8.

Figure 3:
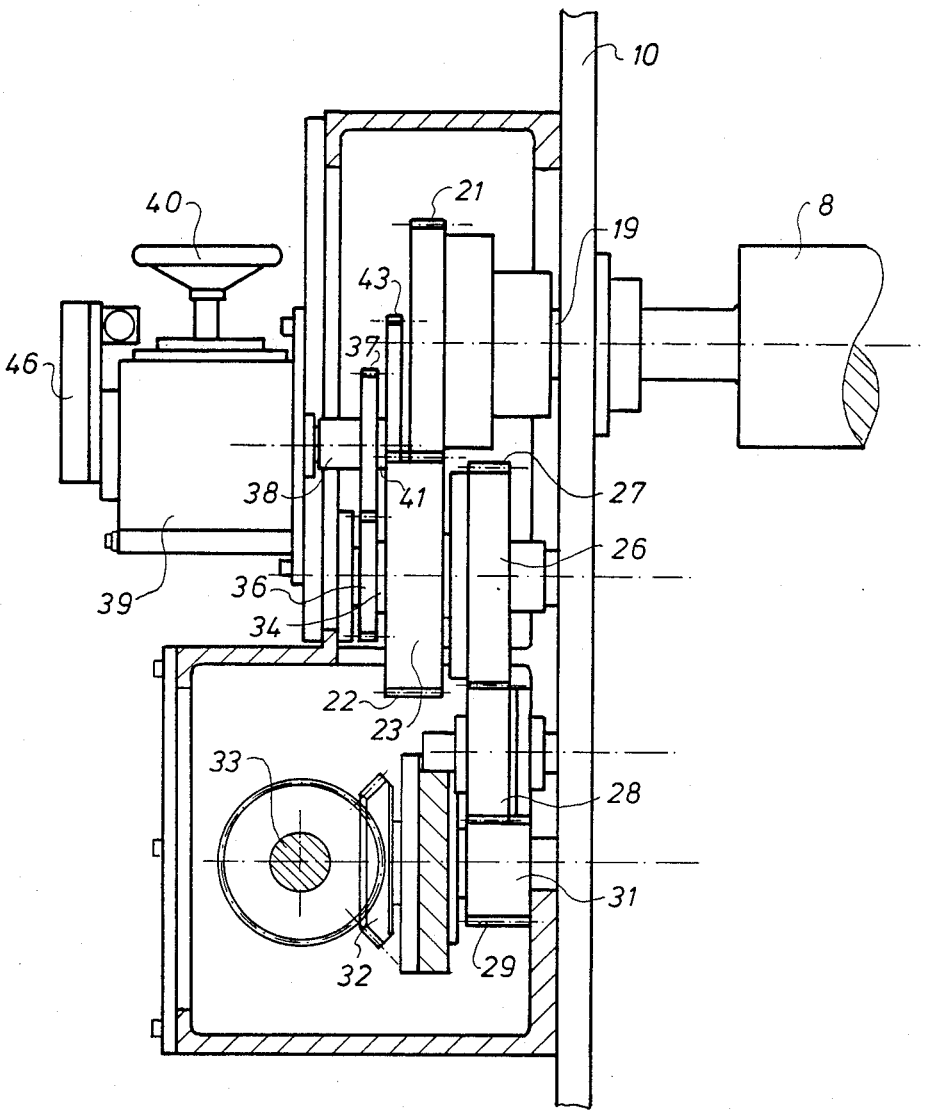
FIG. 3 is a lateral view of the adjustment mechanism for controlling the traction roller, illustrated in diagrammatic form in FIG. 1.

The traction roller 8 is rotatably supported in the side frames 10 of the feed device 1 (see FIG. 3) by means of a shaft 19 which extends through the side frame on the drive side of the apparatus. A gear wheel 21 is mounted on shaft 19 for rotation therewith and is fixed against relative rotation on the shaft. Gear wheel 21 is in gear engagement with a gear wheel 22 which is disposed vertically beneath the gear wheel 21. The gear wheel 22 is fixedly connected with a power take off portion 23 of a conventional compound gear 24. This compound gear may be a harmonic drive, a differential gear, a planetary gear, or the like. This compound gear is driven by a drive element 26 of the compound gear which in turn has a gear wheel 27 that is in geared arrangement with a power input gear wheel 28. A clutch (not shown) is provided for the gear wheel 28 which serves to separate the power input gear 28 for the feed device 1 from the main drive of the printing machine so as to permit maintenance or repair of the drive device. This clutch is not described because it is not a part of the present invention. The gear 28 is driven by a gear wheel 29 mounted on a shaft 31 which is in driving engagement via a bevel gear drive 32 with a longitudinal shaft 33 driven by the main drive of the printing machine.

The compound gear 24 includes a control element 34 which may be a wave generator and which is connected with a gear wheel 36. This gear wheel meshes with a gear wheel 37 which is mounted on an output drive shaft 38 of a continuously adjustable disc drive 39, such as a PIV drive, so that the disc drive 39 drives the control element 34. The input drive shaft 42 of the disc drive 39 carries a gear wheel 43 which is fixed against rotation with respect to shaft 42 and which is in gear engagement with the gear wheel 22 of the power take off 23 of the compound gear 24. Thus, both the gear wheel 43 and the gear wheel 21 engage the gear wheel 22. The main drive of the printing machine drives the gear 26, which in turn drives the power take off gear 23. Gear 23 supplies drive power to the roller 8 through gear wheel 21, and to the disc drive 39 through gear wheel 43 and shaft 42. The disc drive provides adjustable power through shaft 38, gear wheel 37, gear wheel 36, and control element 34 to superimpose another driving speed, in addition to that provided by wheel 26, on the power take off drive wheel 23. As a result, the speed of the power take off wheel might not be identical to that of the drive wheel 26. At the set position of the tension roller, however, when there is no error in the web tension, the speeds of parts 23, 26 and 34 will be the same. See, for example, FIG. 4 of U.S. Pat. No. 3,724,733. The adjustable disc drive 39 has an adjustment device which may be operated by a hand wheel 40 or by a servomotor 46. The servomotor is powered by way of a power driver, or amplifier 47′ (see FIG. 2) which is controlled by the output signal from a control circuit 48.

Figure 2:
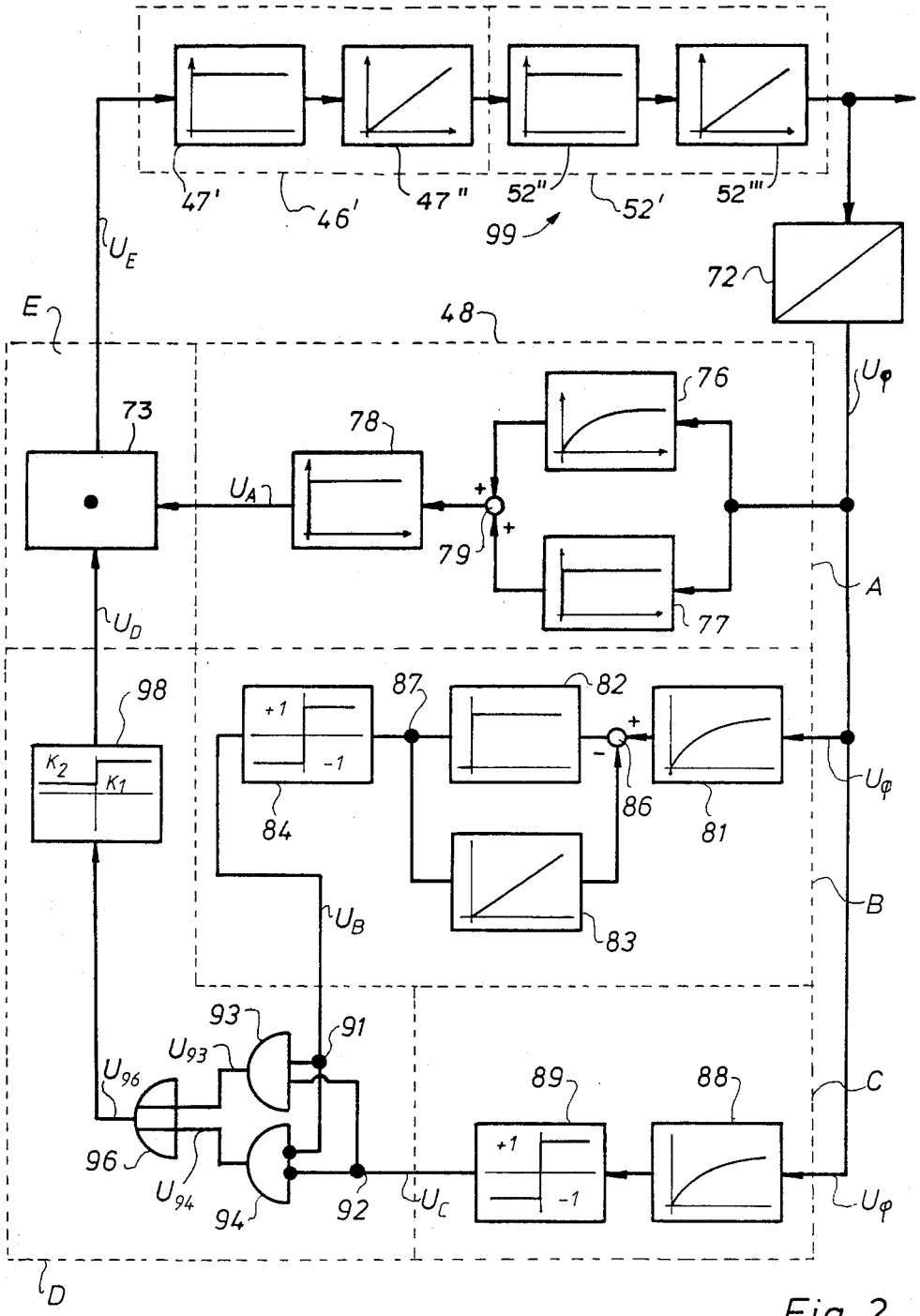
FIG. 2 is a block diagram of a control circuit for the apparatus of FIG. 1, with the transfer functions of the control circuit elements being illustrated.

As illustrated in FIG. 2, the block 46′ represents the operation of the servomotor which is controlled by the control circuit. The servomotor has the behavior of an integrator, in accordance with the automatic control technique of the present invention, and this is illustrated by the integral transfer function 47″. The input signal into element 47″ represents an angular velocity $\dot{\phi}_M$, while the output signal is an adjusting angular velocity $\dot{\phi}_M$.

The differential equation of the mathematical model for the servomotor is:

$$\dot{\phi}_M = K_{47} U_E$$

Since the signal $\dot{\phi}_M$ represents the position needed for block 52′, the integrator behavior is due to the mathematical model of the servomotor.

The angular velocity signal $\dot{\phi}_M$ is also the input to block 52″, which illustrates the behavior of the automatic control system including the drag roller 8, tension roller 52, the disc drive 39, and the compound gear 24. The output of the first block 52″ is a signal representing the drag roller velocity $\dot{\phi}_D$. The second element 52‴ in block 52′ illustrates the behavior of the automatic control technique of the tension roller 52. The output signal from block 52′ indicates the roller position $\phi_T$ of the tension roller 52.

The differential equation of the drag roller velocity is:

$$\dot{\phi}_D = K_{52} \cdot \phi_M$$

and for the tension roller:

$$\phi_T = \frac{1}{T} \int \dot{\phi}_D dt$$

where $\dot{\phi}_D$ is the speed difference to the average speed of the drag roller $\dot{\phi}_D$.

As an alternative, the gear wheel 43 may be connected to the gear wheel 27 of the drive element 26 in the compound gear 24, instead of being connected to the gear wheel 22.

After the web 7 passes over the traction roller 8, it then travels over a first paper web guide roller 51 which deflects the horizontal paper web 7 vertically downwardly. The paper web 7 loops around a tension roller 52 which is in the form of a compensating roller, or dancer, and thereafter is guided vertically upwardly and around a second paper web guide roller 53. Roller 53 is disposed next to the paper web guide roller 51 at approximately the same height and serves to horizontally deflect the paper web 7 to the right, in the direction of the feed rollers 2 and 3.

The compensation roller 52 is rotatably supported on the left ends 54, as viewed in FIG. 1, of a pair of horizontally disposed pivoting levers 56, one lever being located at each end of the roller. The right ends 57 of the pivot levers 56 are supported laterally symmetrically in the side frames 10 of the feed device 1 and are pivotable around an angle $\phi$. A piston rod 58 is connected to the center of each of the pivot levers 56, with a first end 59 of the piston rod being hinged to the pivot lever 56. A second end 60 of each piston rod is fixedly connected to a diaphragm 61 which is sealingly fastened around its circumference 62 to an inner wall 63 of a cylinder 64. The diaphragm 61 and the cylinder 64 form an upper chamber 66 which is connected by way of a pressure line 67 to a pressure tank 68. The pressure tank charges the chamber 66 with a constant pressure $p_0$ which establishes a predetermined, constant pressure on the lever arm 56, and thus on the roller 52 so as to establish a predetermined tension in the web 7. In order to adjust the pressure $p_0$ to the various drawing tensions, the pressure tank 68 is connected by way of an adjustable digital valve 69 to a source of air pressure 70.

The pressure in tank 68, in combination with the weight of the tension roller presses the roller 52 against the web 7 to establish a reference, or nominal pivot angle $\phi$ for the pivot lever 56. A small cover plate 71 is fixedly mounted on the pivot lever 56 for motion therewith, and this cover plate is positioned in front of an analog photoelectric detector 72. The detector 72 generates an electric voltage signal $U_\phi$ in accordance with the position of the cover plate 71 which moves in front of the detector to block more or less light. Since the cover plate moves with the arm 56, the output from the detector 72 is proportional to the pivot angle $\phi$, and this proportional voltage signal $U_\phi$ is fed to the control circuit 48.

The control circuit 48 is illustrated in greater detail in FIG. 2, and as there illustrated, incorporates a plurality of control networks which are illustrated in five blocks labelled A, B, C, D, and E. The blocks A, B and C are connected in parallel to the output of the photodetector 72 while the block D is connected in series with the two blocks B and C. The outputs of blocks A and D are connected to the inputs of a multiplier 73 in block E, with the multiplier producing an output signal $U_E$ which is supplied to the power driver 47' of the servomotor 46. This output signal controls the operation of the servomotor which, in turn, adjusts the disc drive 39 to speed up or slow down the traction roller 8 to thereby decrease or increase, respectively, the tension of the web between the traction roller and the feed rollers 2 and 3.

The tension in web 7 is measured, and also determined by the position of the tensioning roller 52, which is in the form of a compensating roller. The control circuit 48 operates to return the compensating roller 52 to a predetermined set position as quickly as possible after it has been deflected, in order to compensate for any disturbances in the web tension. The set position is defined as the position which is taken by the pivot lever 56 when the web is being drawn under the desired tension, and that tension is undisturbed. In the exemplary embodiment illustrated in FIG. 1, this undisturbed condition is represented by a horizontal position of the lever 56, where the pivot angle $\phi$ equals 0. This set position of the pivot lever 56 may, of course, by any other desired position; for example, it may be vertical, with the present system operating to maintain the pivot lever at that set position. Restoration of the compensating roller 52 after a disturbance in the web tension takes place by way of an adjustment of the rotational speed of the traction roller 8, which is connected to the compensating roller 52 by way of the paper web 7.

Any disturbance of the paper web tension, such as a reduced tension, which would, for example, create a voltage drop from detector 72, results in a further deflection of the compensating roller 52 downwards from the set position in order to maintain the web tension. This deflection of the compensating roller is produced by the pressure in cylinder 64 which moves the diaphragm 61 downwardly and causes the lever arm 56 to pivot downwardly, as viewed in FIG. 1. In order to return the compensating roller 52 to its set position, which is the horizontal position of the lever arm, the rpm of the traction roller 8 must be reduced in order to reduce the speed of the web and thus increase its tension. This is accomplished by the control circuit 48, which determines from the position of the compensating roller, from its rate of change of position, and from the direction of its change, the amount and direction of adjustment required for the continuous adjustment disc drive to return the roll to its nominal position.

Accordingly, the control network responds to the tension voltage $U_\phi$ to generate a voltage which is proportional to the compensating roller position, and supplies this voltage to the control mechanism 48 to drive the adjustment in the adjustable disc drive 39 in such a way as to speed up or slow down the traction roller so as to introduce slack in the web 7, or to increase its tension, as required to maintain the position of the compensating roller. Thus, the control circuit responds to the tension signal, or error signal $U_\phi$, to adjust the disc drive 39 and to generate from the voltage $U_\phi$ which is proportional to the compensating roller position, an initial correcting voltage $U_E$. The control circuit includes circuitry for weighting the control voltage with a large factor K1 (which may equal 1) in those cases when the compensating roller 52 has a tendency to move away from its initial set position, while the control voltage is weighted with a small factor K2 (for example equal to 0.2) when the compensating roller has a tendency to move toward the set position. The different weighting factors lead to a correction signal which causes the compensating roller to tend towards its set position asymptotically so as to provide a stable control of the roller in the presence of disturbances.

Block A of the control circuit includes three control loop elements 76, 77 and 78. The control elements 76 and 77 are connected in parallel to each other with their outputs linked by means of a summing point 79. The control loop element 78 is a P system, which is an ideal proportional unit which reacts suddenly on a sudden input signal. A P element works as a transducer or an amplifier. The element 78 and is connected in series with the outputs of the control loop element 76 and 77, following the summing point 79. The control loop element 76 is a $PT_1$ system, which is a usual P element which reacts to a sudden input signal after a delay. As indicated by the diagrammatic illustration of its transfer function, element 76 functions to filter out the higher spectrum of frequencies produced at the output of the photodetector 72 so that over a period of time, the block A control circuit responds to the low frequency portions of disturbances which are present for an extended period of time. These low frequency signals thus weigh more heavily in the output of block A. The control loop element 77 is a P system having an amplifying function, as does the P system loop element 78. The combination of the low frequency filter 76 and the amplifier 77 causes the circuit of block A to generate a low frequency weighted voltage signal $U_A$ which is proportional to the deviation of the position of the compensating roller 52 from the preselected set position.

The circuit of block B contains four control loop elements 81 through 84. The control loop element 81 is a $PT_1$ system and, as indicated by the transfer function of this loop element, operates to suppress high frequency disturbances. The output of element 81 is supplied to a summing point 86, which is followed by a control loop element 82 in the form of a P system amplifier. The output of element 82 is supplied to a junction 87, to which is connected the control loop element 83 in a negative feedback loop which is connected to the summing point 86. The element 83 is in the form of an I system, which is an ideal integrating element which reacts according to an increasing line transfer function upon a sudden input signal. Its output is calculated from the integral of the input, with $T_1$ as a time constant. The control loop elements 82 and 83 serve to determine the derivative required to identify the rate of change of position of the compensating roller 52 from the changing signal $U_0$ obtained from the photodetector. The junction point 87 is connected to the input of the control loop element 84 which functions as a non-linear two-point control unit which weights the output signal from the control loop element 82. The weighting of the output signal depends on the direction of movement of the compensating roller 52. Thus, weighting the output signal with a positive factor occurs with an upward direction of movement of the compensating roller 52, while weighting with a negative factor occurs with a downward direction of movement of the compensating roller 52. A direction of movement is considered in the absolute, and is independent of the set position. Thus, the block B responds to the direction of change of the detector signal $U_\phi$ to produce a weighted output $U_B$ which indicates the direction of movement of the arm 56 about its mounting point at end 57.

The circuitry in block C contains two control loop elements 88 and 89 which are connected in series. The control loop element 88 is a $PT_1$ system which has a transfer function, as indicated in the drawing, which serves to suppress high frequency disturbances. The control loop element 89 is a non-linear two-point control unit for the determination of the sign of the error signal; i.e., for determining the actual position of the compensating roller 52 with respect to the set point. This control unit weights the detector voltage signal $U_\phi$ with a positive (for example, plus 1) or a negative (for example, minus 1) factor. Weighting with a positive factor takes place after an upward deflection of the compensating roller has occurred, with a negative factor being used after a downward deflection of the compensating roller.

The circuitry of block D contains a recognition logic circuit which receives the output of block B at terminal 91 and which receives the output of block C at terminal 92. The logic circuit consists of elements 93, 94 and 96, which links the output signals $U_B$ and $U_C$ from the blocks C and D with each other. The element 93 is an AND decision gate having the usual AND gate characteristics; that is, if both of the input signals $U_B$ and $U_C$ are positive, the output signal $U_{93}$ from element 93 is also positive. If one or both of the input signals are negative, the output signal $U_{93}$ is also negative. Element 94 is a decision gate with the following NAND characteristics: if one or both of the input signals $U_B$ or $U_C$ is negative, the output signal $U_{94}$ is negative, if both input signals are negative, the output signal $U_{93}$ is positive. Element 96 is a decision gate with OR characteristics; that is, if one of the two output signals $U_{93}$ or $U_{94}$, which are the input signals for element 96, is positive, the output signal $U_{96}$ is also positive. If both of the signals $U_{93}$, $U_{94}$ are negative, the output $U_{96}$ is also negative.

The voltage signal $U_{96}$ is either one of two values, 0 or 1, depending on the direction of motion of tension roller 52. The kind of information (0/1) transmitted to control loop 98 depends on whether the tension roller moves in the direction of the set position or moves away from the set position. When the roller 52 moves toward the set position, the information (0) transmitted to the control element 98 results in a low output voltage $U_D$ from the control block D, and indicates a low adjusting speed for the servomotor 46. When the tension roller 52 moves away from the set position, the information (1) transmitted to the control element 98 results in a high output voltage $U_D$, and indicates a high adjusting speed for the servomotor 46.

Element 98 consists of a non-linear, two-point control unit which weights the input signal $U_{96}$ with a factor $K_1$ (for example equal to one) in the case of a movement of the compensating roller 52 away from its set position, and with a factor $K_2$ (for example equal to 0.2) in the case of a movement of the compensating roller 52 toward its set position.

The block E includes a multiplier element 73 which receives the outputs $U_A$ of block A and $U_D$ of block D and multiplies them. The multiplier increases or decreases the voltage signal $U_D$ and gives it a positive or negative sign, depending on how far the tension roller 52 has left its set position, and on whether that motion is upwards or downwards. In the case of a larger displacement of the roller 52 in a downwards direction, for example, the voltage $U_D$ would be increased and would receive a minus sign in order to rotate servomotor 46 quickly, and in a counterclockwise direction. The resulting control signal $U_E$ to a controlled system 99 which includes, in addition to the power driver 47 and the reversible servomotor 46, the entire compensating roller 52 and photoelectric detector 72. As diagrammatically illustrated in FIG. 2, the servomotor 46 and compensating roller 52 constitute a controlled system which has the behavior of an integrator to provide dynamic control of the position of the tension roller 52 in order to maintain a constant and stable tension on the web 7.

Although the present invention has been described in terms of a preferred embodiment, numerous variations and modifications may be made without departing from the the spirit and scope thereof as set forth in the following claims.

What is claimed is:

1. A device for the controlled infeed of continuous web material (7) to a printing machine having a motorized web drive formed by rollers (8, 9), with a tensioning roller (52) in the form of a compensating roller disposed downstream of the web drive, with a control device (48) based on the actual and nominal value signals ($U_\phi$) of the web tension for the compensating drive of the traction roller (8) and with a differential drive (24) placed upstream of the traction roller (8) and having at least a drive component, a power take-off component and a control component (26, 23, 34), characterized in that the control component (34) can be driven by the main drive (33) of the printing machine by means of an adjustable drive (39).

2. A device in accordance with claim 1, characterized in that the drive (39) is manually adjustable by means of a handwheel (40).

3. A device in accordance with claims 1 or 2, characterized in that for the adjustment of the drive (39) a continuously adjustable and reversible servomotor (46) is provided.

4. A device for the control of the return of a deflectable tensioning roller (52) into a precalculated position in accordance with a tensioning signal $U_\phi$ generated by the deflection of the tensioning roller, characterized in that a control means (48) converts the voltage signal $U_\phi$, in parallel fashion, into a voltage signal $U_A$ which is proportional to a deflection angle ($\phi$), into a voltage signal $U_C$ characterizing the position of the tensioning roller and into a voltage signal $U_B$ weighting the direction of movement of the tensioning roller 52, and that the voltage signals $U_A$, $U_B$, $U_C$, are linked with each other to produce a control signal $U_E$, and means responsive to the signal $U_E$ for controlling the deflection of the tensioning roller (52).

5. A device (48) for the control of the return of a deflectable tensioning roller (52) into a precalculated position in accordance with a tensioning signal $U_\phi$ generated by the deflection of the tensioning roller, characterized in that three control blocks (A, B, C) are disposed parallel, that the control blocks (A, B, C) each have a $PT_1$ system (76, 81, 88), in that the $PT_1$ system (76) of the control block (A) is switched parallel with a P system (77), that a summing point (79) is provided which positively links the output signals of the control loop elements (76, 77), that behind the summing point (79) a further P system (78) is disposed, that behind the $PT_1$ system (81) of the control block (B) a summing point (86) is disposed, that behind the summing point (86) a P system is provided, the output signals of the last-mentioned P system are routed at a branch point (87) to the summing point (86) via a negative feedback loop, that the negative feedback loop has an I system, in that behind the summing point (87) a non-linear control loop element (84) is disposed, that behind the $PT_1$ system (88) of the block (C) a non-linear control loop element (89) is disposed, that the output signals ($U_B$, $U_C$) of the control blocks (B, C) are linked by means of a recognition logic circuit (93, 94, 96), that behind the recognition logic circuit (93, 94, 96) a non-linear control loop element (98) is disposed, and that the output signal ($U_D$) of the control block (D) which contains the recognition logic circuit (93, 94, 96) is multiplicatively linked with an output signal ($U_A$) of the control block (A).

6. A device for controlling the tension of a web comprising a web;

feed roller means for said web;

traction roller means supplying said web to said feed roller;

tension roller means in contact with said web between said traction roller means and said feed roller means and having a predetermined nominal position corresponding to a desired web tension and being movable from said nominal position in response to changes in the tension of said web;

detector means responsive to the motion of said tension roller means for producing a tension signal;

control means responsive to said tensioning signal for producing a control signal, said control means including first circuit means producing a first voltage signal proportional to the motion of said tension roller, second circuit means for producing a second voltage signal corresponding to the position of said tension roller with respect to an initial position, and third circuit means for producing a third weighted voltage signal corresponding to the direction of movement of the tension roller, said first, second and third circuit means being connected in parallel to said tensioning signal, and means responsive to said first, second and third voltage signals for producing said control signal; and adjustable drive means responsive to said control signal for driving said traction roller means so as to maintain a predetermined tension in said web.

7. The device of claim 6, wherein said adjustable drive means comprises a differential drive for changing the rate of rotation of said traction roller means with respect to the rate of rotation of said feed roller means to change the tension of said web in a direction to tend to return said tension roller means to its nominal position.

* * * * *